US007799661B2

(12) United States Patent
Rauf

(10) Patent No.: US 7,799,661 B2
(45) Date of Patent: Sep. 21, 2010

(54) ELECTRICAL SENSOR FOR REAL-TIME FEEDBACK CONTROL OF PLASMA NITRIDATION

(75) Inventor: Shahid Rauf, Pflugerville, TX (US)

(73) Assignee: Freescale Semiconductor, Inc., Austin, TX (US)

( * ) Notice: Subject to any disclaimer, the term of this patent is extended or adjusted under 35 U.S.C. 154(b) by 968 days.

(21) Appl. No.: 11/324,425

(22) Filed: Jan. 3, 2006

(65) Prior Publication Data

US 2007/0155185 A1 Jul. 5, 2007

(51) Int. Cl.
*H01L 21/322* (2006.01)
*H01L 21/00* (2006.01)
*H01L 21/26* (2006.01)

(52) U.S. Cl. ..... 438/474; 438/475; 438/485; 438/513

(58) Field of Classification Search ..... 438/474, 438/485, 513

See application file for complete search history.

(56) References Cited

U.S. PATENT DOCUMENTS 5,760,573 A * 6/1998 Paranjpe et al. ..... 324/71.1
6,452,400 B1 * 9/2002 Kawai et al. ..... 324/459
6,559,942 B2 5/2003 Sui et al. ..... 356/369
6,563,578 B2 5/2003 Halliyal et al. ..... 356/237.4
6,627,463 B1 9/2003 Sarfaty ..... 438/7
6,723,663 B1 4/2004 Wieczorek et al. ..... 438/776
6,864,109 B2 3/2005 Chang et al. ..... 438/16
2003/0098288 A1 * 5/2003 Mori et al. ..... 216/2
2005/0030003 A1 * 2/2005 Strang ..... 324/101
2008/0085604 A1 * 4/2008 Hoshino et al. ..... 438/712

* cited by examiner

*Primary Examiner*—Matthew C Landau
*Assistant Examiner*—James M Mitchell
(74) *Attorney, Agent, or Firm*—John A. Fortkort; Fortkort & Houston P.C.

(57) ABSTRACT

A device (101) for controlling the treatment of a substrate (102) with a plasma (103) is provided which comprises (a) a plasma chamber (104) adapted to generate a plasma (103); (b) a sensor (113) equipped with first (115) and second (117) electrodes that are exposed to the plasma generated within the chamber, said sensor being adapted to (i) apply a first low frequency voltage $V_1$ to the first electrode, (ii) apply a plurality of high frequency voltages $V_2 \ldots V_n$ to the first electrode, where $n \geqq 2$, and (iii) measure the respective currents $I_1 \ldots I_n$ flowing through the second electrode during application of each of the voltages $V_1 \ldots V_n$, respectively; and (c) a data processing device (121) adapted to determine the densities of a plurality of ion species based on currents $I_1 \ldots I_n$ and on a mathematical model or on calibration data relating to the plasma chamber.

16 Claims, 6 Drawing Sheets

ELECTRICAL SENSOR FOR REAL-TIME FEEDBACK CONTROL OF PLASMA NITRIDATION

FIELD OF THE DISCLOSURE

The present disclosure relates generally to semiconductor plasma processes, and more particularly to methods for quantitatively measuring species densities in the plasmas utilized in these processes.

BACKGROUND OF THE DISCLOSURE

Continuing advances in integrated circuit technology have led to an ongoing need to decrease minimum feature sizes. This scaling down of integrated circuits has resulted in the use of ultra-thin gate oxide films. Such films, which may be less than 20 Å thick, are often subjected to nitridation to improve the resistance of the film to dopant penetration, to decrease the leakage current of transistors that incorporate these films, and to improve the resistance to radiation damage of devices incorporating these films. A variety of film nitridation processes are currently known to the art, including thermal anneal processes, ion implantation processes, and plasma nitridation processes (both remote and in situ).

The rate and degree of nitridation in a typical nitridation process usually depends on a number of variables, such as temperature, plasma power, gas flow rates, chamber pressure, and the like. Regardless of the type of nitridation process used, it is typically important to accurately control both the depth and the degree of nitridation. In the past, this has frequently been accomplished through the use of timed techniques. While such techniques can provide adequate nitridation control in some applications, these techniques do not provide real-time quantitative information on the plasma properties as would be useful to improve process control in many applications.

There is thus a need in the art for a method for providing real-time quantitative feedback on plasma properties in plasma treatment processes. There is further a need in the art for semiconductor fabrication equipment which utilizes such a process. These and other needs may be met by the devices and methodologies described herein.

DETAILED DESCRIPTION

Figure 1:
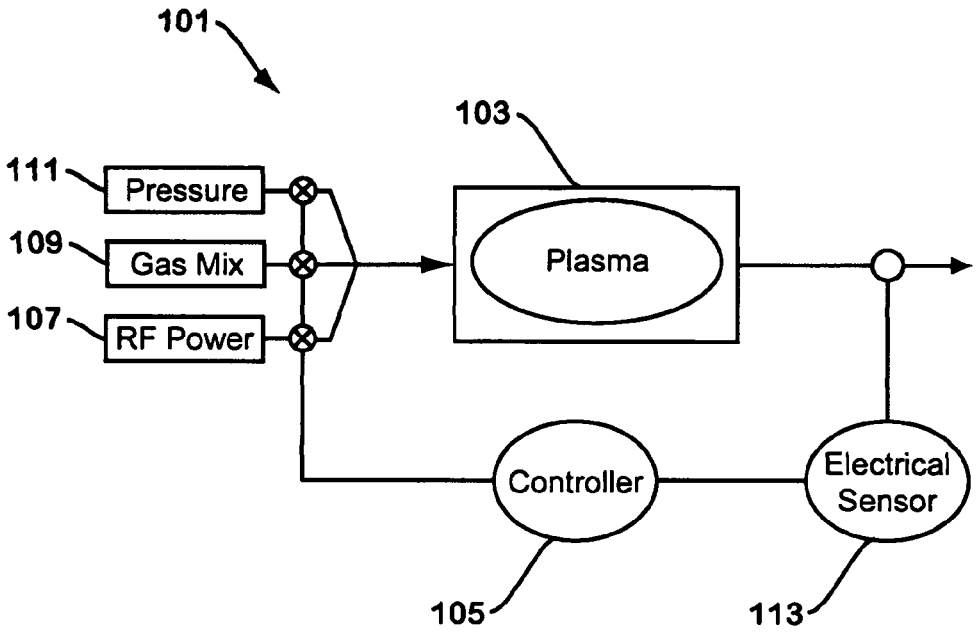
FIG. 1 is an illustration of a real-time feedback control system in accordance with the teachings herein.

In one aspect, a method is provided for quantitatively determining species densities in a plasma during treatment of a substrate with the plasma. In accordance with the method, a plasma chamber is provided which is equipped with first and second electrodes that are exposed to a plasma generated within the chamber. A plurality of voltages $V_1 \ldots V_n$ are applied to the first electrode, wherein $n \geqq 2$, wherein $V_1$ is a low frequency voltage, and wherein $V_2 \ldots V_n$ are high frequency voltages. The respective currents $I_1 \ldots I_n$ flowing through the second electrode are measured during application of each of the voltages $V_1 \ldots V_n$, respectively, and the currents $I_1 \ldots I_n$ are used to determine the densities of individual ion species in the plasma. The ion densities can then be utilized to obtain information about neutral reactive species (such as, for example, atomic N).

In another aspect, a device for controlling the treatment of a substrate with a plasma is provided. The device comprises (a) a plasma chamber adapted to generate a plasma; (b) a sensor equipped with first and second electrodes that are exposed to the plasma generated within the chamber, said sensor being adapted to (i) apply a first low frequency voltage $V_1$ to the first electrode, (ii) apply a plurality of high frequency voltages $V_2 \ldots V_n$ to the first electrode, where $n \geqq 2$, and (iii) measure the respective currents $I_1 \ldots I_n$ flowing through the second electrode during application of each of the voltages $V_1 \ldots V_n$, respectively; and (c) a data processing device adapted to determine the densities of a plurality of ion species, based on currents $I_2 \ldots I_n$ and on a mathematical model or calibration data. The device also preferably comprises a memory storage device for storing information relating to the mathematical model or calibration data relating to the plasma chamber.

These and other aspects of the present disclosure are described in greater detail below.

It has now been found that the aforementioned needs may be met by utilizing, in a plasma process, a sensor which is equipped with a first and second electrode to quantitatively measure the densities of individual ion species in the plasma. This may be accomplished, for example, by applying a low frequency, low amplitude voltage and a series of high frequency, low amplitude voltages at various input frequencies to the first electrode, and measuring the current flow in the second electrode for each of the input frequencies. The measured currents may then be used in conjunction with a mathematical model or calibration data to determine the densities of ion species in the plasma. The determined ion densities may then be used to adjust the parameters of the plasma treatment process so that the same or similar ion densities are achieved from one process to the next. This ensures that the effect of the plasma treatment process will be essentially the same from one process to the next, even if there is some variation in certain process parameters. This approach is particularly suitable for controlling the plasma treatment of gate dielectrics and other dielectric substrates, and is especially suitable for controlling the plasma nitridation of such substrates.

The devices and methodologies disclosed herein may be further understood with respect to the first particular, non-limiting embodiment depicted in FIG. 1 of a system made in accordance with the teachings herein. The system 101 comprises a plasma chamber 103 which is managed by a controller 105. The controller 105 manipulates the various control elements and parameters that affect the characteristics and profile of a plasma generated within the chamber, including the RF power supply 107, the gas mixture 109 entering the plasma chamber, and the pressure 111 within the chamber. While these functionalities have been segregated for purposes of illustration, one skilled in the art will appreciate that, in practice, they may be partially or wholly combined in various permutations. Thus, for example, the plasma chamber may be equipped with a gas manifold 109 which may play a role both in determining the gas mixture entering the chamber 103 and the atmospheric pressure within the chamber 103.

Referring again to FIG. 1, the plasma chamber 103 is equipped with an electrical sensor 113 that is in communication with the controller 105. As will be described in greater detail below, the electrical sensor 113 obtains a series of current measurements that may be utilized by the controller 105 to determine the densities of the various component ion species of the plasma being generated within the plasma chamber 103. This information may then be used to adjust the parameters (such as, for example, gas pressure, plasma source power, pulsing frequency, pulse duty cycle, gas flow rate, and/or gas mixture) that influence the composition of the plasma. For example, during the nitridation of a gate dielectric, this information may be used to control the relative densities of the individual nitrogen ion species (such as, for example, $N^+$ and $N_2^+$) or neutral species (such as, for example, N) involved in the nitridation, which can significantly improve process yield and wafer-to-wafer or chamber-to-chamber consistency.

Figure 2:
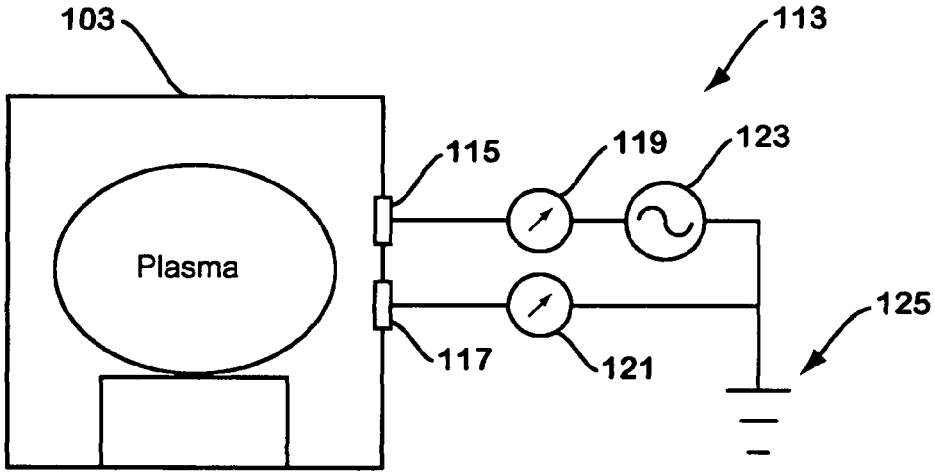
FIG. 2 is an illustration of an electrical sensor in accordance with the teachings herein for measuring nitrogen species densities in a plasma.

With reference now to FIG. 2, the details of the sensor 113 of FIG. 1 may be appreciated. As seen therein, the sensor 113 comprises first 115 and second 117 electrodes that are exposed to the plasma within the plasma chamber 103 and that are in electrical communication with first 119 and second 121 ammeters (or galvanometers), respectively, the later of which are adapted to measure the current flow through the first 115 and second 117 electrodes, respectively.

The first 115 and second 117 electrodes may comprise various metals, such as, for example, aluminum, copper, and tungsten, and may be placed at any suitable location on the walls of the plasma chamber 103. Preferably, the first 115 and second 117 electrodes will be in direct contact with the plasma. However, since the measurements described herein are typically made at radio frequencies, the first 115 and second 117 electrodes may be coated with a thin dielectric film to avoid metal sputtering or contamination. The first 115 and second 117 electrodes will also typically be electrically insulated from the chamber walls. This may be accomplished through the placement of a thin dielectric material (which may be in the form of a liner or sleeve) between each of the electrodes and the chamber walls.

There are no particular restrictions on the shape, size or placement of the electrodes. Typically, these parameters will be implementation-specific and will depend on the sensitivity of the ammeter used, the power supply (or supplies), and the geometry of the plasma chamber 103, among other factors. However, small, closely-spaced electrodes in the region of highest plasma density are preferred.

An RF power source 123, which is equipped with a suitable ground 125, is provided. The RF power source 123 is adapted to supply voltages of varying amplitude and frequency to the first electrode 115. In particular, the RF power source 123 is adapted to provide at least both low frequency (that is, less than 1 MHz, and more preferably within the range of about 150 kHz to about 300 KHz), low amplitude and high frequency (that is, about 1 to about 30 MHz), low amplitude voltages to the first electrode 115. While the power source 123 is shown in FIG. 2 as being a single component of the sensor 113, one skilled in the art will appreciate that, in practice, the power source 123 may also be a combination of a plurality of distinct power sources.

In use, the sensor 113 operates to determine the densities of individual ion species in a plasma within the plasma chamber 103 by applying a first low frequency, low amplitude voltage $V_1$ to the first electrode 115, and measuring the associated current $I_1$ which flows through the second electrode 117. Next, the sensor 113 applies a series of high frequency, low amplitude voltages $V_2 \ldots V_n$ to the first electrode 115, where $n \geqq 2$, and measures the associated currents $I_2 \ldots I_n$ that flow through the second electrode 117 during the application of each of these voltages.

As explained in greater detail below, the measured currents $I_1 \ldots I_n$ may then be used to determine the densities of individual ion species within the plasma. The ion densities can be calculated from a mathematical model or from calibration data for the plasma chamber. These calculations will typically be implemented by a processor which may be incorporated into the sensor 113, into the controller 105, or into a device (such as a computer) which is in communication with the sensor 113.

One particular, non-limiting example of a mathematical model that may be utilized to calculate ion densities is described below. This model was also used to test the efficacy in determining ion densities of the system depicted in FIGS. 1-2. Of course, one skilled in the art will appreciate that the concepts and methodologies described herein are not limited to this model, and that other models (such as, for example, 2-dimensional models, sheath models, and models based on calibration tables) can also be used to determine ion densities or to test the systems described herein.

The model assumes a plasma nitridation process of the type commonly utilized for the nitridation of gate oxides. Given the densities ($n_{i(P)}$) of N ions in the bulk plasma (e.g., $N_2^+$ and $N^+$) and the electron temperature $T_e$, the following equations are solved to determine the plasma potential ($\phi_P$) and sheath thickness (s):

$$\phi_P = -T_e \ln\left(\frac{\sqrt{2\pi m_e}}{\sum_{i=1}^{N} n_{i(P)}} \sum_{i=1}^{N} \left(\frac{n_{i(P)}}{\sqrt{m_i}}\right)\right) \quad \text{(EQUATION 1)}$$

$$s = \frac{\sqrt{2}}{3} \sqrt{\frac{\varepsilon_0 T_e}{e \sum_{i=1}^{N} n_{i(P)}}} \left(\frac{2\phi_P}{T_e}\right)^{3/4} \quad \text{(EQUATION 2)}$$

wherein $m_i$ is the mass of species i;

$m_e$ is the electron mass;

e is the electron charge; and $\in_0$ is the vacuum permittivity.

It has been assumed above that the sheath is collision-less and obeys Child's law, and that the ion and electron currents are equal at the plasma chamber walls. When no RF voltage is applied to electrode 115 (see FIG. 2), the steady-state electrical potential ($\phi_0$), ion densities ($n_{i0}$) and ion velocities ($v_{i0}$) in the sheath regions are calculated using the following equations:

$$\phi_0(x) = \phi_P\left(\frac{x}{s}\right)^{4/3} \quad \text{(EQUATION 3)}$$

$$v_{i0}(x) = \sqrt{\frac{q_i}{m_i}(T_e - 2(\phi_0 - \phi_P))} \quad \text{(EQUATION 4)}$$

$$n_{i0}(x) = \frac{n_{i(P)}}{v_{i0}}\left(\frac{q_i T_e}{m_i}\right)^{1/2} \quad \text{(EQUATION 5)}$$

wherein $q_i$ is the charge on species i; and x is the distance from input (first) electrode;

Details of such steady-state plasma property calculations and of the equations involved therein can be found, for example, in M. A. Lieberman and A. J. Lichtenberg, "Principles of Plasma Discharges and Materials Processing", pp. 156-166, Wiley, New York (1994).

For these given plasma conditions ($\phi_0$, $n_{i0}$, $v_{i0}$), a low amplitude RF voltage is applied at one end of the plasma. The RF potential, ion densities, electron density, and ion velocities are computed using a linearized form of the following equations:

$$\frac{d^2\phi}{dx^2} = -\frac{1}{\varepsilon_0}\left[\sum_{i=1}^{N} q_i n_i - e n_e\right] \quad \text{(EQUATION 6)}$$

$$\frac{\partial n_i}{\partial t} + \frac{\partial}{\partial x}(n_i v_i) = 0 \quad \text{(EQUATION 7)}$$

$$m_i n_i \frac{\partial v_i}{\partial t} + m_i n_i v_i \frac{\partial v_i}{\partial x} = -n_i q_i \frac{\partial \phi}{\partial x} - k_B T_i \frac{\partial n_i}{\partial x} - m_i n_i v_i v_i \quad \text{(EQUATION 8)}$$

wherein $n_i$ is the density of species i;

$v_i$ is the velocity of species i;

$T_i$ is the temperature of species i;

$v_i$ is the collision frequency of species i;

$\phi$ is the electrical potential;

$k_B$ is the Boltzmann constant; and $n_e$ is the electron density.

Under the model, ions are assumed cold ($T_{ion}$=0) and collisionless ($v_{ion}$=0). Following these plasma calculations, the RF current density ($J_{RF}$) is computed using the following equation:

$$J_{RF} = -\varepsilon_0 \frac{\partial^2 \phi}{\partial x \partial t} + \sum_{i=1}^{N}(q_i n_{i0}(v_i - v_{i0}) + q_i v_{i0}(n_i - n_{i0})) \quad \text{(EQUATION 9)}$$

The results of this simulation are depicted in FIGS. 3-11.

Within the sensor 113 of FIG. 2, the above model is actually used in inverse. That is, initial values for ion densities and electron temperature are first assumed or approximated, and RF currents ($I=J_{RF}\times A$, where A is area of electrode 117 in FIG. 2) are calculated for all frequencies of interest. Based on the difference between calculated and measured RF currents, ion densities and electron temperature are then adjusted to reduce model-experiment disparity. This procedure is repeated until the computed RF currents agree with the empirical measurements. Given the linear or monotonic dependence of RF currents on ion densities and electron temperature (see FIGS. 7-11 below), only a few iterations of this process are typically required to converge on the final ion densities and electron temperature.

Once determined, the final ion densities (and preferably also the electron temperature) can be used as a means to ensure product uniformity from one product batch to another. In particular, by controlling the nitridation process (or other plasma treatment process) in such a way that the final ion densities (and preferably also the electron temperature) are the same from one batch to another, the effects of the plasma treatment process will be highly reproducible, even if other parameters (such as, for example, the pressure within the plasma chamber or the RF power) vary somewhat between batches. This is because ion densities and electron temperature are more directly related to the effect of the plasma process than other variables (such as pressure and RF power) that are commonly relied upon to ensure product uniformity.

Figure 3:
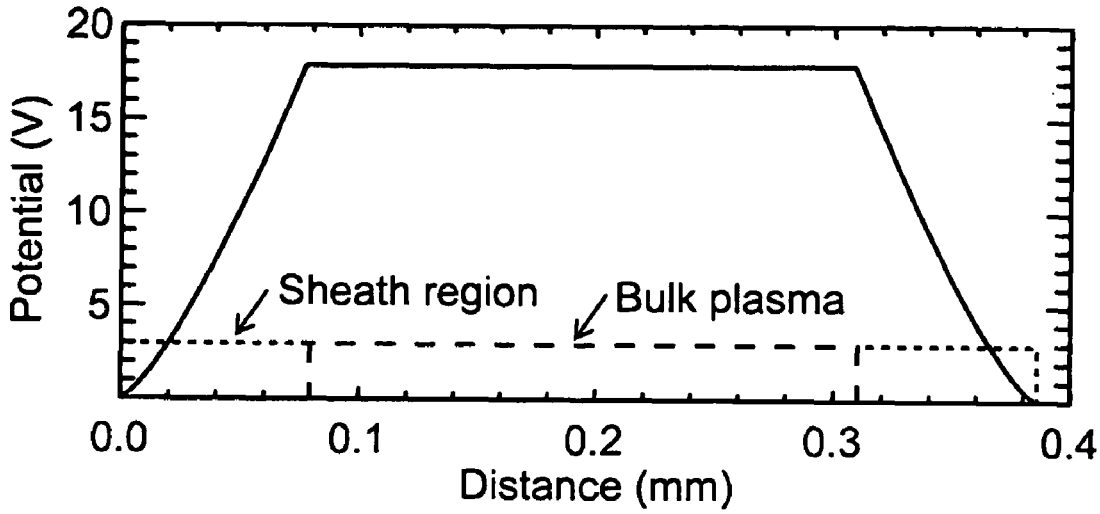
FIG. 3 is a graph of predicted potential (in Volts) as a function of distance from the plasma chamber surface (in mm)
Figure 4:
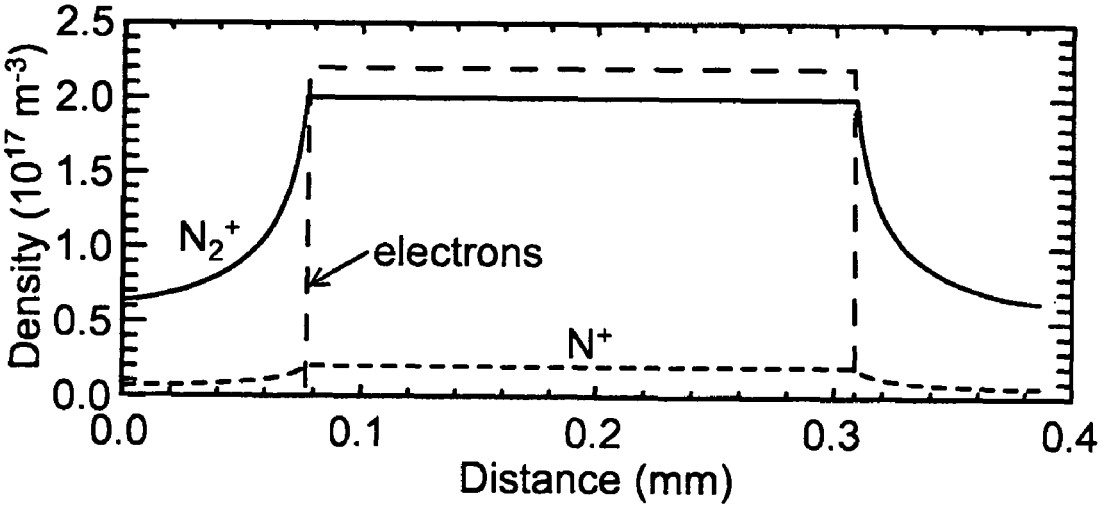
FIG. 4 is a graph of ion density (in $10^{17}$ $m^{-3}$) as a function of distance from the plasma chamber surface (in mm)
Figure 5:
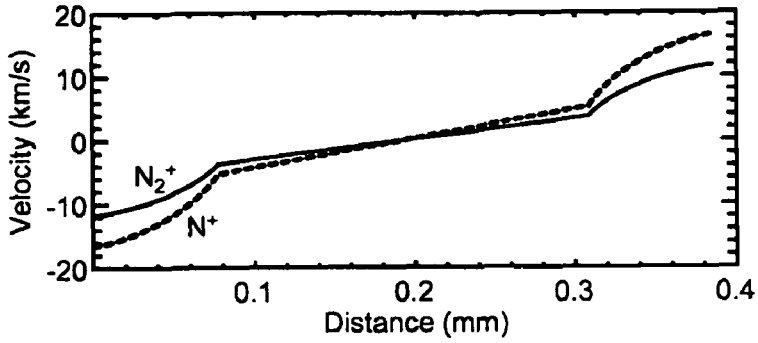
FIG. 5 is a graph of ion velocity (in km/s) as a function of distance from the plasma chamber surface (in mm)

The one-dimensional plasma model described above was used to test the feasibility of the system depicted in FIGS. 1-2 in a nitridation process and to determine the optimal operating regime (i.e., RF frequencies and RF voltages). As shown in FIG. 3, which is a graph of predicted potential as a function of distance from the substrate surface, the model predicts the formation of a sheath in the plasma in the vicinity of the substrate where the electric field is significantly large. The electric field serves to repel electrons away from the substrate surface, and to accelerate ions toward the substrate surface. Consequently, as shown in FIG. 4 (which is a graph of ion density as a function of distance from the substrate surface), the model predicts that ion densities will decrease and, as shown in FIG. 5 (which is a graph of ion velocity as a function of distance from the substrate surface), that ion velocities will increase (since the product nv of mass and velocity remains constant), as one moves from the bulk plasma towards the substrate surface.

Figure 6:
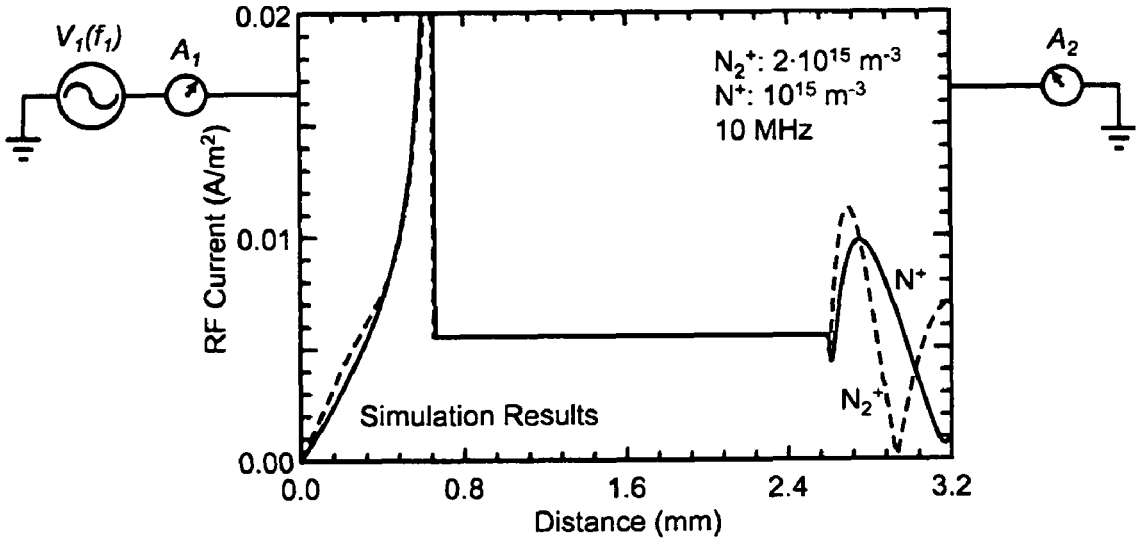
FIG. 6 is a graph of RF current (in $A/m^2$) as a function of distance (in mm) from the plasma chamber surface.

Referring now to FIG. 6, which is a graph of RF current as a function of distance from the substrate surface, when a high frequency, low amplitude voltage ($V_{applied} \ll V_{plasma}$) of greater than 2 MHz is applied to the input (first) electrode 115 of FIG. 2, ions with different masses (specifically, $N_2^+$ and $N^+$ in the present example) accelerate differently in the sheath due to their differing inertias. Notably, the relative contribution of different ions to the output RF current (that is, the current measured at the second or output electrode 117) changes with RF frequency. The methodologies described herein advantageously utilize this variation of individual ion currents due to inertia to determine individual ion densities.

Figure 7:
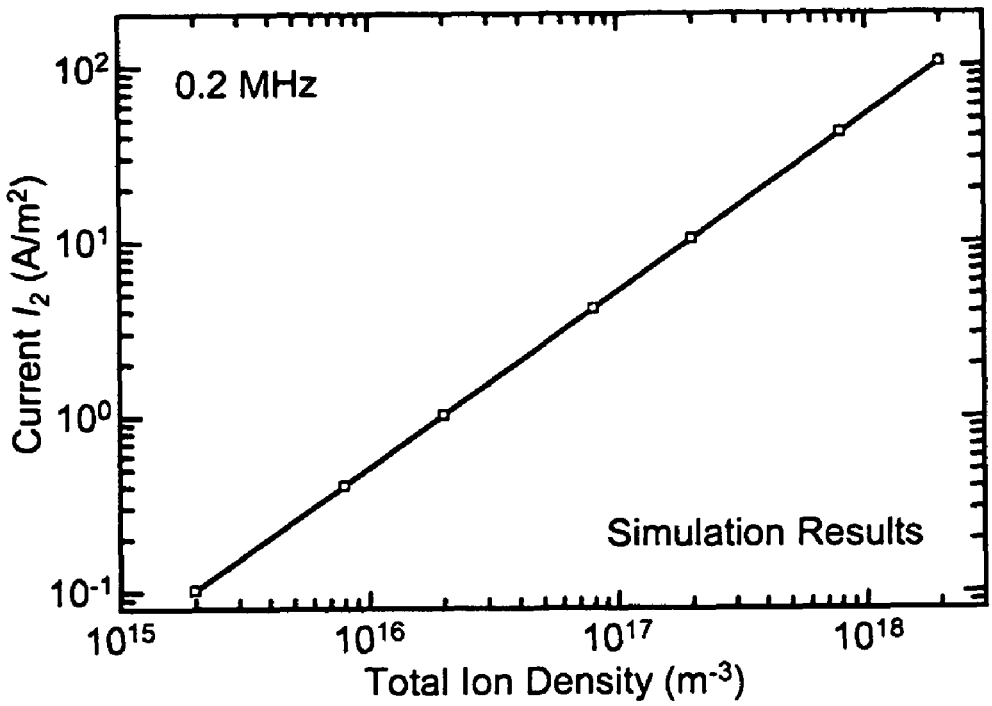
FIG. 7 is a graph of RF current (in $A/m^2$) as a function of total ion density (in $m^{-3}$)

The sensor 113 first determines the total ion density in the plasma. FIG. 7 depicts a graph of current as a function of total ion density as predicted by the one-dimensional plasma model. As seen therein, the model predicts that the output RF current (that is, the current measured at the second electrode 117 of FIG. 2) will increase monotonically with total ion density when RF frequency is low (that is, within the range of about 150 to about 300 kHz) and when displacement current is smaller than ion current (these terms are explained in greater detail below). This, in turn, suggests that the output current as measured at the second electrode 117 of FIG. 2 after application of a low frequency input voltage to the first electrode 115 can be used in conjunction with a model or calibration table to determine the total density of ions in the plasma. In particular, the model or calibration table can be used to establish the coefficients of the linear function.

As noted above, output RF current (that is, the current measured at the second electrode 117 of FIG. 2) is predicted by the model to increase monotonically with total ion density when RF frequency is low and when displacement current is smaller than ion current. Displacement current is a current arising from time-varying electric and magnetic fields and is, for example, the phenomenon responsible for current flow through a capacitor and for the propagation of electromagnetic waves from an antenna to a radio. In the present application, displacement current flows through the plasma sheaths (see FIG. 3) within the plasma chamber, since the plasma sheaths behave as capacitors. Ion current is the physical current produced when charged ions carry charge (or current) to the electrodes of the sensor. Since only the ion current component of total RF current contains ion density information, output RF current measurements are made either at low frequencies (where displacement current is negligible compared to ion current) or with the out-of-phase component of current (to which displacement current does not contribute). Displacement currents and ion currents can vary over a wide range, and depend on such factors as frequency, voltage and plasma conditions.

Figure 8:
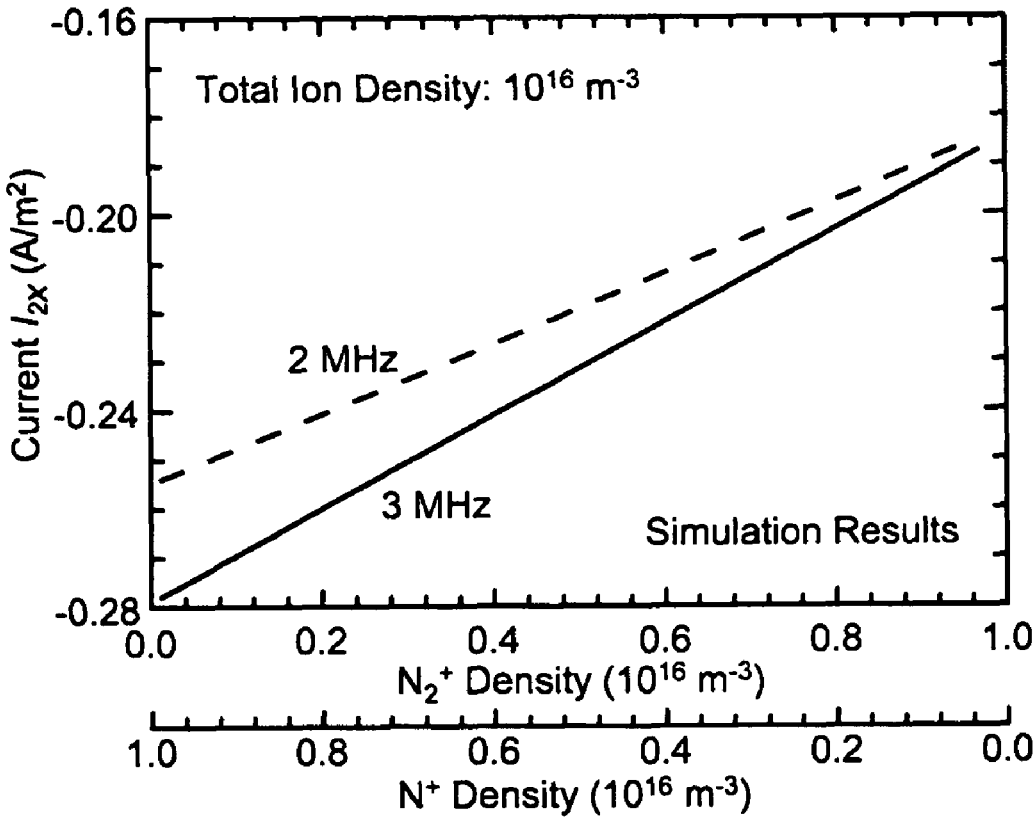
FIG. 8 is a graph of the out-of-phase component of RF current $I_{2X}$ (in $A/m^2$) as a function of ion density (in $10^{16}$ $m^{-3}$) for both $N_2^+$ and $N^+$ ion species and at frequencies of 2 MHz and 3 MHz.

Once the total density of ions in the plasma is determined, a second set of measurements is taken to determine the densities of individual ion species (e.g., $N_2^+$ and $N^+$ in this example) in the plasma. Based on total ion density, one can select suitable frequencies for a second set of measurements which provide the best sensitivity to relative fractions of different ions in the plasma. FIG. 8 is a graph of the out-of-phase component of output current $I_{2X}$ as a function of ion density for two ion species (namely, $N_2^+$ and $N^+$) as predicted in a nitridation simulation at input currents of 2 MHz and 3 MHz at electrode 115 of FIG. 2, assuming a total ion density of $10^{16}$ $m^{-3}$. The out-of-phase component $I_{2X}$ of RF current $I_2$ is defined as $$I_{2X}=I_2-I_2\cdot V_{applied}/|V_{applied}| \quad \text{(EQUATION 10)}$$

where $I_2$ and $V_{applied}$ are complex numbers and also include information about phase.

Figure 9:
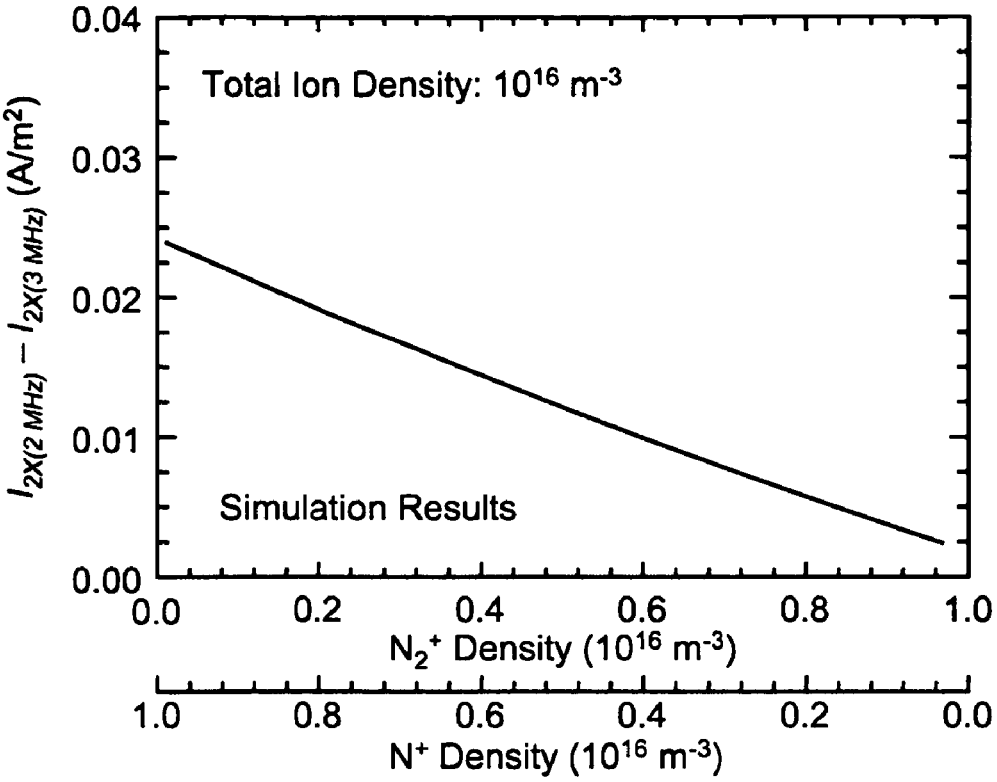
FIG. 9 is a graph of $I_{2X(2\ MHz)}-I_{2X(3\ MHz)}$ (in $A/m^2$) as a function of ion density (in $10^{16}$ $m^{-3}$) for both $N_2^+$ and $N^+$ ion species.
Figure 10:
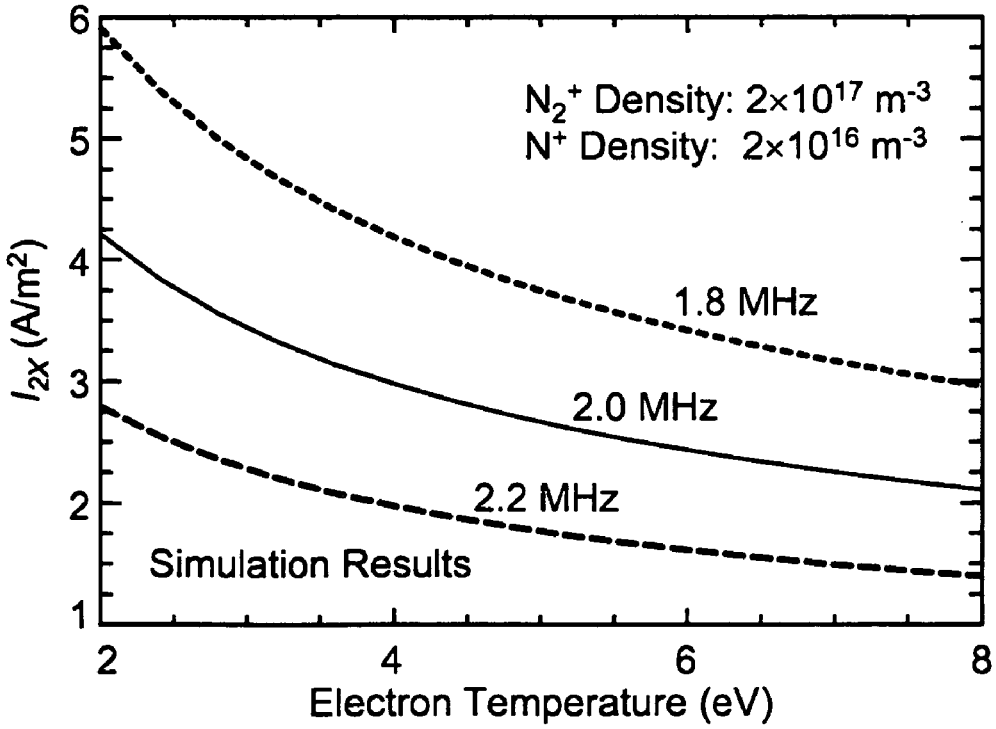
FIG. 10 is a graph of the out-of-phase component of RF current $I_{2X}$ (in $A/m^2$) as a function of electron temperature at frequencies of 1.8 MHz, 2.0 MHz and 2.2 MHz.

The out-of-phase component of the output current measured at the second electrode 117 is solely a function of ion flow, and does not include a contribution from displacement current. As seen in FIG. 8, due to ion inertia, the output ion current measured at the second electrode 117 of FIG. 2 is a linear function of relative ion composition. Given the measured $I_{2X}$, one can use a mathematical model or calibration data to determine the density of the individual component ions of the plasma. Although multiple frequency measurements are not essential for measuring the density of two ions, the difference in the ion current ($I_{2X(f1)}-I_{2X(f2)}$) as measured at the second electrode 117 at the two frequencies also linearly varies with ion composition, as shown in FIG. 9, and this dependence can be used to determine individual ion densities. Multiple frequency measurements also allow one to determine electron temperature $T_e$, as shown in FIG. 10, which can be used to determine the density of neutral atomic species (such as, for example, N radicals) using the model. Also, multiple frequency measurements are essential to measure the densities of more than 2 ions (as would be required, for example, if $N_2$ is mixed with He, Ar, Ne, Xe, Kr or $O_2$ during plasma treatment, thus producing $He^+$, $Ar^+$, $Ne^+$, $Xe^+$, $Kr^+$, $O_2^+$ or $O^+$ ions).

Figure 11:
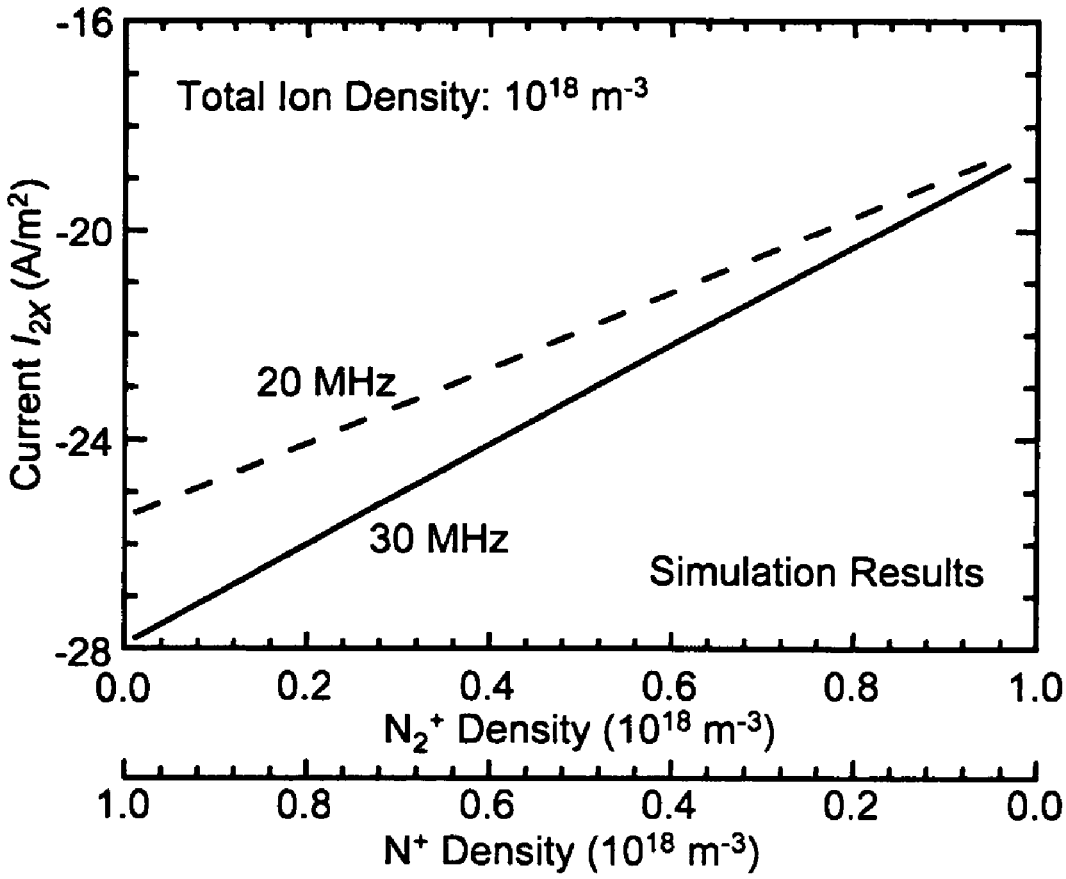
FIG. 11 is a graph of the out-of-phase component of RF current $I_{2X}$ (in $A/m^2$) as a function of total ion density (in $10^{18}$ $m^{-3}$) for both $N_2^+$ and $N^+$ ion species at frequencies of 20 MHz and 30 MHz.

FIG. 11 is a graph of the out-of-phase component of output RF current as a function of ion density for two ion species (namely, $N_2^+$ and $N^+$) as predicted in a nitridation simulation at input currents of 20 MHz and 30 MHz, and assuming a total ion density of $10^{18}$ $m^{-3}$. Again, due to ion inertia, the out-of-phase component of output RF current measured at electrode 115 of FIG. 2 is seen to be a linear function of relative ion composition.

In light of the foregoing, it will be appreciated that a sensor 113 of the type depicted in FIGS. 1-2, which is equipped with a first 115 and second 117 electrode, may be used in a plasma process to quantitatively measure the density of individual ion species in a plasma by applying a low frequency, low amplitude voltage and a series of high frequency, low amplitude voltages at various input frequencies to the first electrode, and by measuring the current flow in the second electrode 117 for each of the input frequencies. The measured currents may then be used in conjunction with a mathematical model or calibration data to determine the densities of individual ion species in the plasma. This approach is particularly suitable for controlling the plasma treatment of gate dielectrics and other dielectric substrates, and is especially suitable for controlling the plasma nitridation of such substrates.

The above description of the present invention is illustrative, and is not intended to be limiting. It will thus be appreciated that various additions, substitutions and modifications may be made to the above described embodiments without departing from the scope of the present invention. Accordingly, the scope of the present invention should be construed in reference to the appended claims.

What is claimed is:

1. A method for quantitatively determining species density in a plasma during treatment of a substrate with the plasma in a plasma chamber equipped with first and second electrodes, comprising:

applying a plurality of voltages $V_1 \ldots V_n$ to the first electrode, wherein $n \geqq 2$, wherein $V_1$ is a low frequency voltage, and wherein $V_2 \ldots V_n$ are high frequency voltages;

measuring the respective currents $I_1 \ldots I_n$ flowing through the second electrode during application of each of the voltages $V_1 \ldots V_n$, respectively; and using the currents $I_1 \ldots I_n$ to determine the density of an individual ion species in the plasma.

2. The method of claim 1, wherein the currents $I_1 \ldots I_n$ are used in conjunction with a mathematical model or calibration data to determine the density of an individual ion species in the plasma.

3. The method of claim 1, wherein $V_1 \ldots V_n$ are low amplitude voltages.

4. The method of claim 1, further comprising adjusting at least one parameter of the plasma treatment based on the determined density of at least one ion species.

5. The method of claim 1, wherein the voltage $V_1$ has a frequency of less than 1 MHz.

6. The method of claim 1, wherein the voltage $V_1$ has a frequency within the range of about 150 to about 300 kHz.

7. The method of claim 1, wherein each of the voltages $V_2 \ldots V_n$ has a frequency within the range of about 1 to about 30 MHz.

8. The method of claim 1, wherein the currents $I_1 \ldots I_n$ are used to determine the density in the plasma of an ion species selected from the group consisting of $N_2^+$, $N^+$, $He^+$, $Ar^+$, $Ne^+$, $Xe^+$, $Kr^+$, $O_2^+$ and $O^+$.

9. The method of claim 1, wherein the currents $I_1 \ldots I_n$ are used to determine the density in the plasma of both $N_2^+$ and $N^+$.

10. The method of claim 9, wherein the density of at least one neutral species in the plasma is also determined.

11. The method of claim 1, wherein n=2.

12. The method of claim 1, wherein the substrate is a gate oxide.

13. The method of claim 12, wherein the treatment is a nitridation treatment.

14. The method of claim 1, wherein $V_1$ is used to determine total ion density in the plasma, and wherein at least one of $V_2 \ldots V_n$ is used to determine the density of an individual ion in the plasma.

15. The method of claim 1, wherein the species density in the plasma is determined during treatment of a substrate with the plasma.

16. The method of claim 1, wherein the voltages $V_1 \ldots V_n$ giving rise to currents $I_1 \ldots I_n$ are applied to the same plasma.

* * * * *